US007210299B2

(12) United States Patent
Yang

(10) Patent No.: US 7,210,299 B2
(45) Date of Patent: May 1, 2007

(54) ROTARY TYPE ICE MAKER AND METHOD FOR MAKING ICE USING THE SAME

(75) Inventor: Ho Nam Yang, Seoul (KR)

(73) Assignee: LG Electronics Inc., Seoul (KR)

( * ) Notice: Subject to any disclaimer, the term of this patent is extended or adjusted under 35 U.S.C. 154(b) by 143 days.

(21) Appl. No.: 11/060,783

(22) Filed: Feb. 18, 2005

(65) Prior Publication Data

US 2006/0117784 A1 Jun. 8, 2006

(30) Foreign Application Priority Data

Dec. 2, 2004 (KR) ..... 10-2004-0100137

(51) Int. Cl.
*F25C 1/10* (2006.01)

(52) U.S. Cl. ..... 62/71; 62/353

(58) Field of Classification Search ..... 62/71, 62/73, 351, 353; 249/78, 111, 114.1, 115, 249/119, 137
See application file for complete search history.

(56) References Cited

U.S. PATENT DOCUMENTS 4,233,819 A * 11/1980 Stottmann ..... 62/349
5,425,248 A * 6/1995 Trantina ..... 62/349
6,145,320 A * 11/2000 Kim ..... 62/6
6,481,235 B2 * 11/2002 Kwon ..... 62/353
7,010,934 B2 * 3/2006 Choi et al. ..... 62/353

FOREIGN PATENT DOCUMENTS

KR 10-2004-0102562 A 12/2004

* cited by examiner

*Primary Examiner*—William E. Tapolcai
(74) *Attorney, Agent, or Firm*—Birch, Stewart, Kolasch & Birch, LLP

(57) ABSTRACT

Disclosed are a rotary type ice maker and a method for making ice using the same. The rotary type ice maker comprises an ice making mold having ice making cavities in upper and lower sides thereof, respectively, a rotating shaft for supporting the ice making mold so that the ice making mold is rotated by its own weight or by the weight of ice cubes in the ice making cavities, and a mold position fixing device for fixing or releasing the ice making mold by engaging with the ice making mold or separating from the ice making mold.

16 Claims, 8 Drawing Sheets

PRIOR ART

PRIOR ART

PRIOR ART

PRIOR ART

ROTARY TYPE ICE MAKER AND METHOD FOR MAKING ICE USING THE SAME

FIELD OF THE INVENTION

This invention generally relates to an ice maker of a refrigerator, where water is frozen into ice cubes, and more particularly, to a rotary type ice maker and a method for making ice using the ice maker, wherein ice cubes can be removed by their own weight by reversing an ice making mold in which water is frozen into the ice cubes, whereby several components for making the ice cubes are not required and also the cost of production can be lowered by a reduction of the number of parts thereof.

BACKGROUND OF THE INVENTION

Generally, an ice maker comprises an ice making mold with a plurality of ice making cavities containing water therein to be frozen by cold air generated from a freezer of a refregerator and making water into ice cubes.

As shown in FIG. 1, a conventional refrigerator having a freezing compartment F and a refrigerating compartment R therein, which are divided each other by a barrier 101, comprises a body 102 in which a refrigerating system is equipped for cooling the freezing compartment F and the refrigerating compartment R to low temperature, the freezing compartment door 103 connected to the body 102 for opening and closing a freezing compartment F, and a refrigerating compartment door 104 connected to the body 102 for opening and closing the refrigerating compartment R.

The refrigerating system comprises a compressor for compressing refrigerant of low temperature and pressure, a condenser in which the refrigerant of high temperature and pressure through the compressor radiates heat toward outside air and is condensed, an expanding device in which the refrigerant condensed in the condenser is decompressed, and an evaporator in which the refrigerant expanded in the expanding device absorbes heat of air circulated from the freezing compartment F and the refrigerating compartment R and is evaporated.

Recently, it is a general tendency that an automatic ice maker is provided in the refrigerator such that ice cubes can be taken out after ice cubes are made using cold air in the freezing compartment F.

The ice maker comprises an ice maker 105 which is provided in an upper part of an inner side of the freezing compartment F and makes the supplied water into ice cubes by cold air in the freezing compartment F, an ice bank 106 which is provided in an inner side of the freezing compartment F for releasing the ice cubes made in the ice maker 105 and containing the ice therein, a dispenser 107 which is provided in a freezing compartment door 103 for extracting the ice cubes to the outside without opening and closing the freezing compartment door 103, and a chute 108 for guiding the ice cubes in the ice bank 106 to be dropped to the dispenser 107.

As shown in FIG. 2 to FIG. 4, the ice maker 105 comprises an ice making mold 12 having a plurality of ice making cavities for making ice cubes, a water supply cup for supplying water to the ice making cavities of the ice making mold 12, a heater 16 for melting and separating the frozen ice cubes from the ice making mold 12, an ejector 18 for ejecting the ice cubes made in the ice making mold 12, a stripper 20 provided for sliding and dropping the ejected ice cubes to the ice bank 106, and an ice making controller 22 for controlling water supply to the water supply cup 14 and also controlling the heater 16 and the ejector 18.

Further, the ice making mold 12 is provided with a plurality of partitions 12 *a* for dividing an ice making space of the ice making mold 12 into a plurality of cavities. The heater 16 is provided in a bottom wall of the ice making mold 12 for partially melting the frozen ice cubes and separating them from the ice making mold 12.

Further, the ejector 18 is positioned such that an ejector shaft 18*a* thereof goes across a upper side of a center of the ice making mold 12. The ejector shaft 18*a* is formed with a plurality of ejector pins 18*b* protruded toward a side surface thereof.

The ejector shaft 18*a* has a one end which is protruded into the ice making controller 22 and connected to a driven gear 18*c*, and the ice making controller 22 contains a motor 23 for generating a driving force for rotating the ejector 18 and a temperature sensor 24 for measuring the temperature of the ice making mold 12.

A driving gear 23*a* engaged with the driven gear 18*c* is connected to a shaft of the motor 23, and the temperature sensor 24 is closely mounted on a sidewall of the ice making mold 12 opposite to the sidewall of the ice making mold 12 where the water supply cup 14 is mounted and measures the temperature of the ice making mold 12.

However, in the ice maker 105 having the above-mentioned structure, several components such as the ejector 18, the motor 23, the stripper 20, and so on for extracting the frozen ice cubes there from have been used and thus the structure thereof was complex. Thus, there have been several drawbacks in that price competitiveness of products was lowered due to many components for the ice maker 105 and also maintenance and repairs of the ice maker 105 were difficult.

Meanwhile, referring to an ice maker disclosed in the U.S. Pat. No. 5,425,248 as shown in FIG. 5 and FIG. 6, the ice maker 200 for a freezer F of a refrigerator comprises a double-sided ice cube tray 202 having a housing 201, and first ice cube cavities 203 are formed in an upper part of the double-sided ice cube tray 202 and second ice cube cavities 204 are formed in a lower part of the double-sided ice cube tray 202.

The ice maker 200 further comprises a means for rotating the housing 201 from an upper position to a lower position and vice versa.

Consequently, the ice maker 200 can repeat operations of ice making and ice-release by rotating the double-sided ice cube tray 202 of the ice maker 200 using the rotation means.

That is, water is supplied to the first ice cube cavities 203 of the double-sided ice cube tray 202 through a water supply tube 205, the double-sided ice cube tray 202 is rotated by the rotation means if the supplied water is frozen and ice making thereof is finished, in this state, water is again supplied to the second ice cube cavities 204 facing upward, and the ice-separating operation is performed in the first ice cube cavities 203 facing downwardly during the ice making operation in the second ice cube cavities 204.

In addition, the rotation means comprises a solenoid 211 mounted in the freezer F by a bracket 210 and also has a plunger 212 that serves as a locking device to the solenoid 211. The plunger 212 is engaged with a pinion 213 such that the pinion 213 can be rotated one-half turn in one direction or the other way around.

The pinion 213 is fixedly attached to a shaft 214, and is rotatably mounted to the freezer F of the refrigerator by bearings 215 which are fixedly attached to both ends of the shaft 214, respectively.

Other such means for rotating the housing 201 may comprise a linear motor in place of the solenoid 211. Also, a motor connected to the shaft 214 for reversible rotation of the housing 201 can be adopted.

However, because the means for rotating the double-sided ice cube tray 202 is complicatedly constructed in the ice maker 200, a lot of cost and labor is required in manufacturing of the ice maker 200. As a result, the maintenance and repairs of the ice maker 200 were difficult, and price competitiveness of products was lowered due to the expensive unit cost of parts for the rotating means.

SUMMARY OF THE INVENTION

Accordingly, it is an object of the invention to provide a rotary type ice maker and a method for making ice using the ice maker, wherein the ice cubes can be separated by their own weight by rotating an ice making mold in which water is frozen into the ice cubes, whereby several additional components for releasing the ice cubes are not required and also price competitiveness of products can be secured by a reduction of the number of parts thereof.

To accomplish the object of the invention, there is provided a rotary type ice maker according to the invention comprising: an ice making mold having ice making cavities in upper and lower sides thereof, respectively; a rotating shaft for supporting the ice making mold so that the ice making mold is rotated by its own weight or by the weight of ice cubes in the ice making cavities; and a water supply pipe for supplying water to the ice making mold.

Further, there is a provided a method for making ice using the rotary type ice maker comprising the steps of: holding an ice making mold having ice making cavities in upper and lower sides thereof, respectively, the ice making cavities corresponding each other; supplying water into upper cavities of the ice making mold; making ice cubes by freezing water supplied into upper cavities of the ice making mold; releasing the ice making mold for rotating the ice making mold; rotating the ice making mold by its own weight or by the weight of the ice cubes in the ice making mold; holding the ice making mold in a reversed position; supplying water into upper cavities of the reversed ice making mold; and separating the ice cubes in lower cavities by their own weight.

Here, the ice making mold may be provided with a fixing groove on at least one sidewall thereof. The fixing groove receives a fixing shaft of the solenoid moved forwardly for holding the ice making mold.

Further, the ice making mold may be provided with a heater in the whole surfaces of all the walls thereof for releasing the ice cubes.

That is, the rotary type ice maker having the above constitution can separate the ice cubes by rotating the ice making mold itself. Thus, the ice maker of the invention can be embodied as a simple structure without additional components such as the ejector, the stripper, and so on in the prior art.

Thus, according to a rotary type ice maker of the present invention, since additional devices for ejecting the ice cubes are not required, the number of parts of the ice maker can be reduced. Accordingly, price competitiveness of products can be secured by a reduction of the number of parts thereof and a reduction of the material cost. Further, a decrease of the heat quantity spent in releasing the ice cubes can be conducive to the temperature maintenance of the refrigerator, thereby improving an ice making performance of the ice maker.

DETAILED DESCRIPTION OF THE PREFERRED EMBODIMENTS

The above-mentioned features and operations of the structures will be described in detail in connection with the preferred embodiments of the rotary type ice maker according to the invention.

Figure 1:
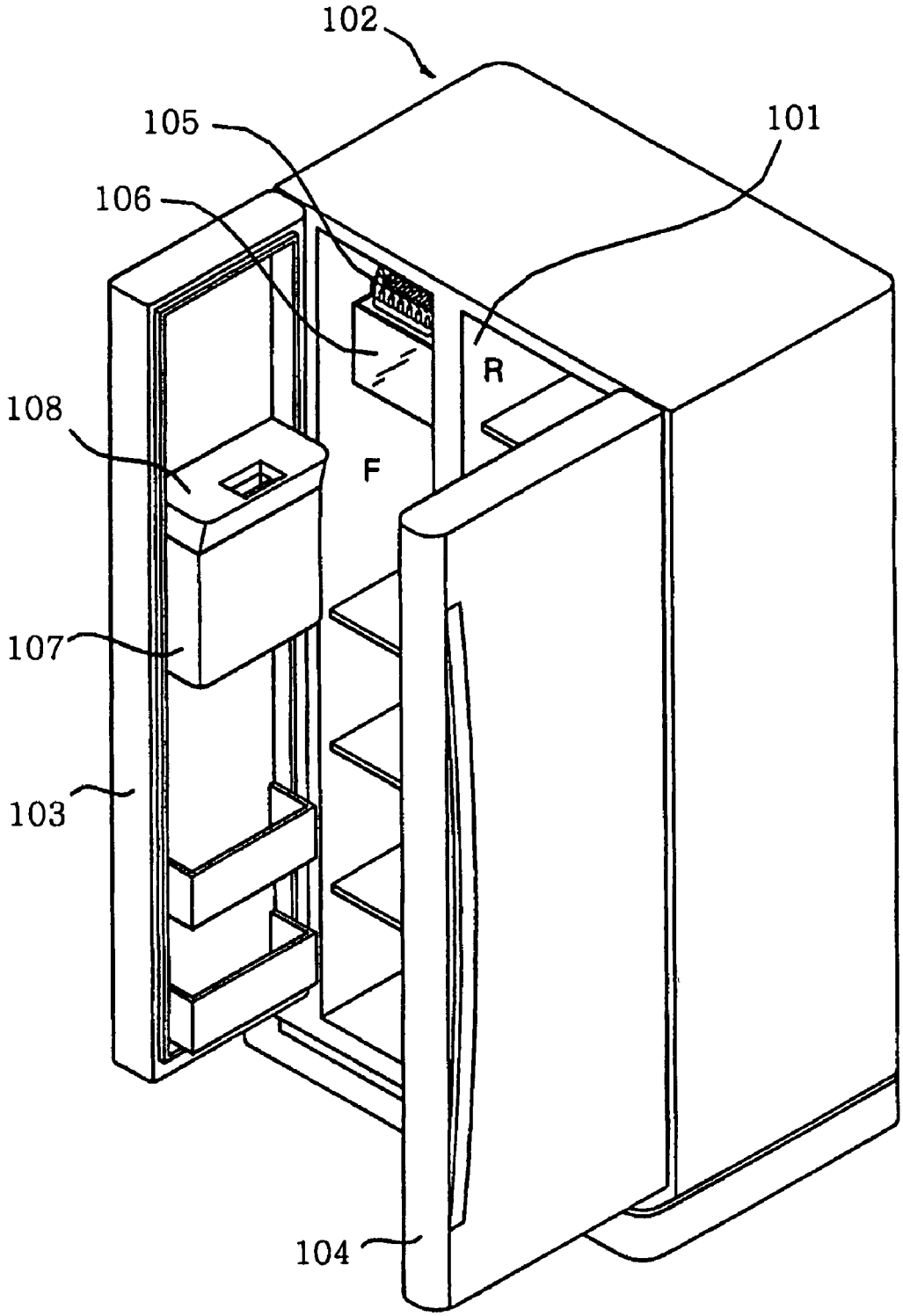
FIG. 1 is a perspective view of a refrigerator, which shows an arrangement of a conventional ice maker.
Figure 2:
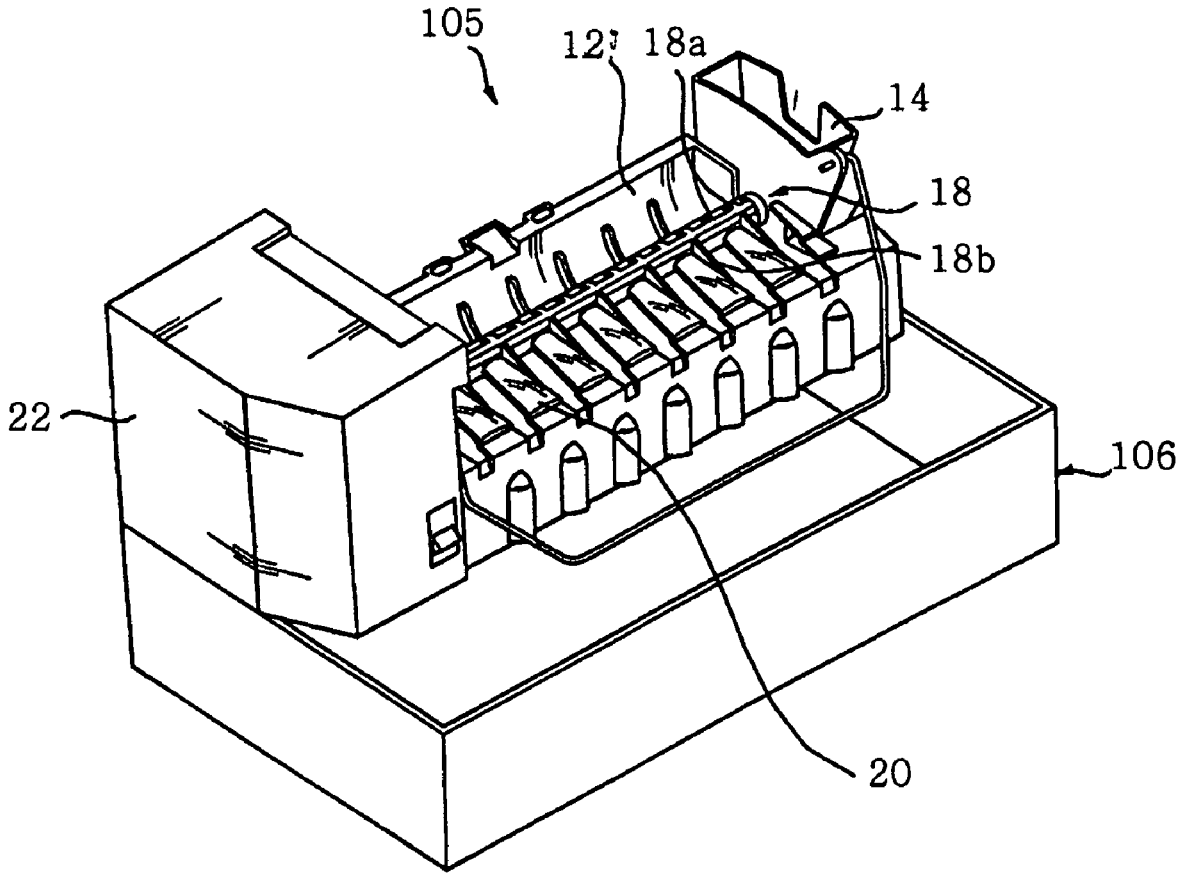
FIG. 2 is a perspective view of the conventional ice maker.
Figure 3:
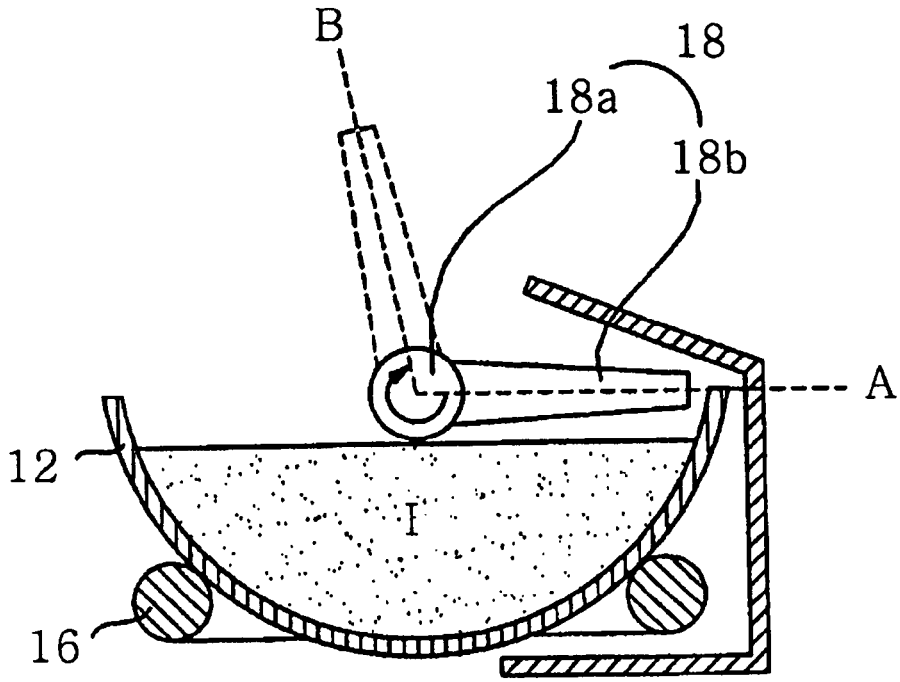
FIG. 3 is a transverse cross section of the conventional ice maker.
Figure 4:
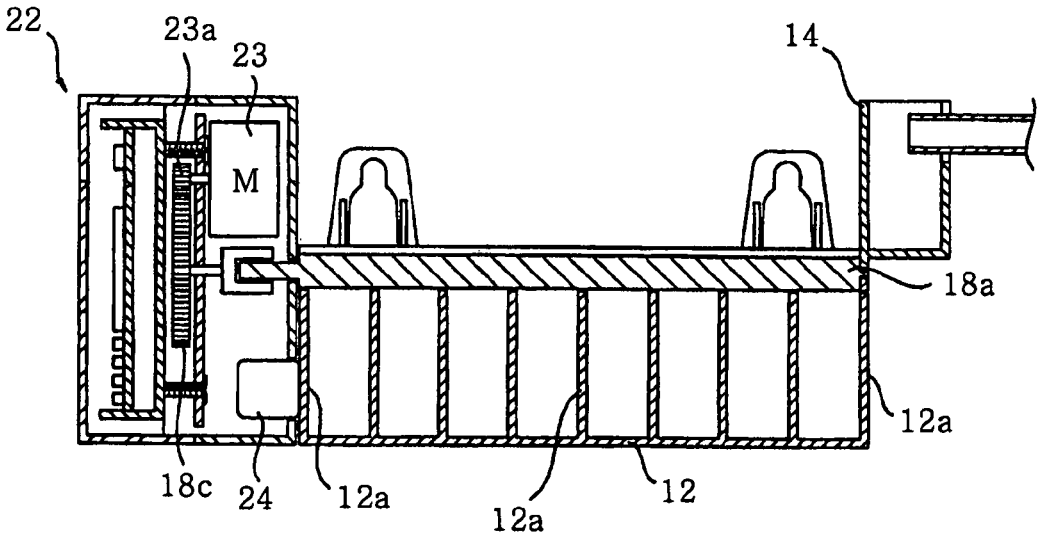
PRIOR ART FIG. 4
FIG. 4 is a longitudinal cross section of the conventional ice maker.
Figure 5:
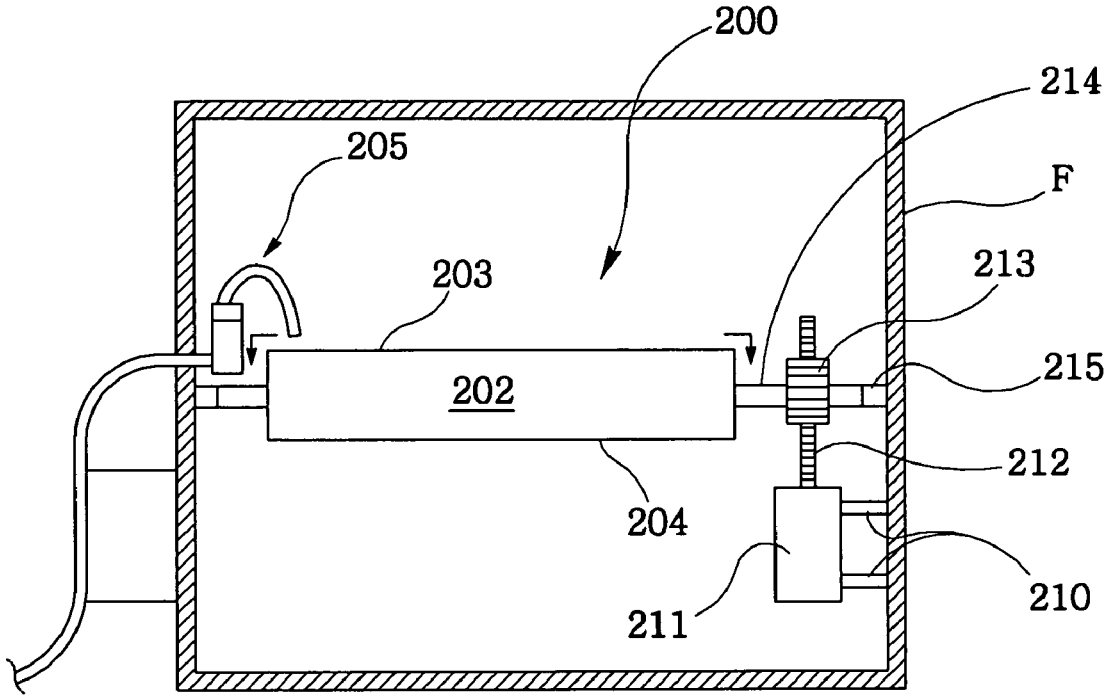
FIG. 5 is a schematic view showing a construction of a prior rotary type ice maker.
Figure 6:
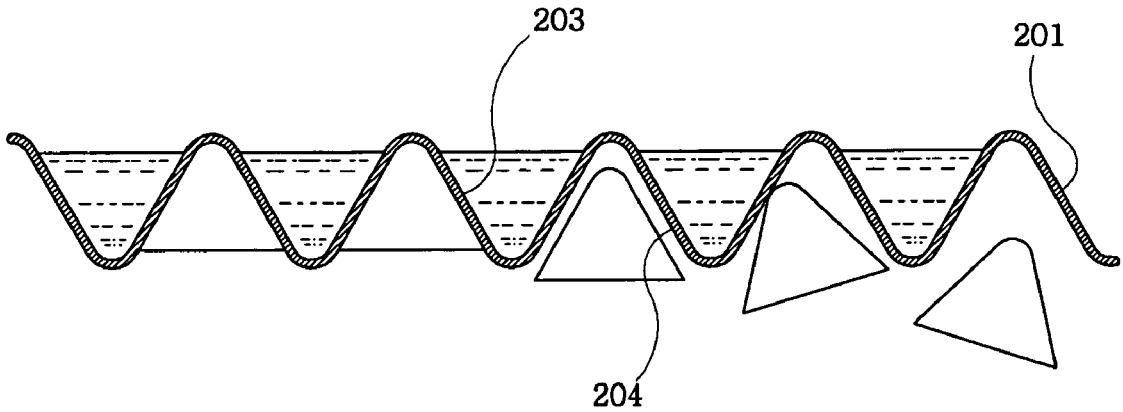
PRIOR ART FIG. 6
FIG. 6 is a cross section view of the ice making mold of the prior rotary type ice maker.
Figure 7:
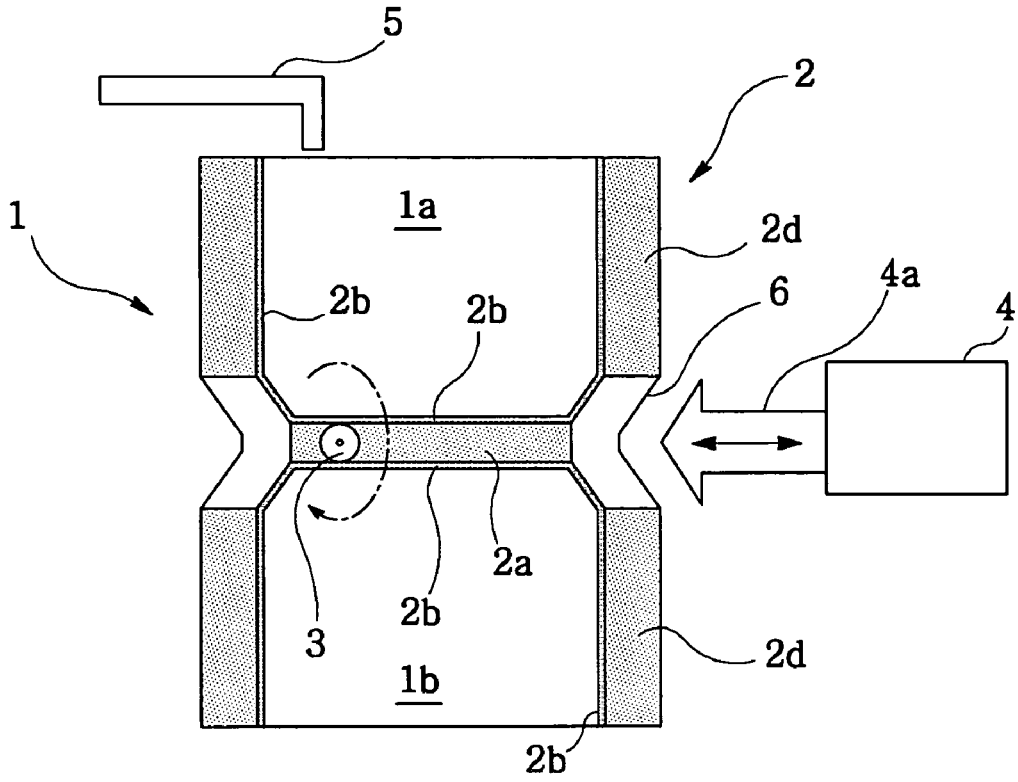
FIG. 7 is a transverse cross section view of a rotary type ice maker according to the present invention.

A rotary type ice maker 1 according to the present invention, as shown in FIG. 7, comprises an ice making mold 2, which has a plurality of upper ice making cavities 1*a* opened upwardly and a plurality of lower ice making cavities 1*b* opposite to the upper ice making cavities 1*a* and opened downwardly.

A rotating shaft 3 is longitudinally inserted in the bottom wall 2*a* of the ice making mold 2 to support the ice making mold 2 and eccentrically located in a width direction thereof to give a self-rotation to the ice making mold 2 by its own weight or by the weight of ice cubes in the upper ice making cavities 1*a*.

A mold position fixing device is provided for holding or releasing the ice making mold 2. The mold position fixing device holds the ice making mold 2 while water is poured into the upper ice making cavities 1*a* and frozen therein, and releases the ice making mold 2 to reverse it by its own weight or by the weight of the ice cubes therein.

The mold position fixing device comprises a solenoid 4 and a fixing shaft 4*a* moved forwardly or backwardly by the solenoid 4. With a view to holding the mold 2, the fixing shaft 4*a* moves forwardly and engages with a fixing groove 6 formed on the outer sidewall of the mold 2. With a view to releasing the mold 2, the fixing shaft 4*a* retracts from the fixing groove 6.

A water supply pipe is provided over the upper ice making cavities l*a* for supplying water in a water supply cup(not shown) into the cavities 1*a*.

According to the rotary type ice maker 1, the ice making mold 2 has substantially "H" shape and rotates about the rotating shaft 3 which is eccentrically installed, whereby the ice cubes are released by their own weight or by the weight of the ice making mold 2.

As the rotary type ice maker 1 has the above mentioned structure, it can release the ice cubes by allowing the ice making mold 2 to be reversed by itself. Thus, as the ice maker 1 of the present invention can get a simple structure, such a device as the ejector or the stripper of the prior ice maker is not required.

Further, the upper and lower sides of the ice making mold 2 have a symmetrical shape with respect to each other.

The inner sidewalls of the upper ice making cavities 1*a* and the lower ice making cavities 1*b* may be coated with substance 2*b* for increasing thermal conductivity of the inner sidewalls and minimizing a friction force between the inner sidewalls and the ice cubes. As a result, the ice cubes in the upper ice making cavities 1*a* or the lower ice making cavities 1*b* can be easily separated.

Figure 8:
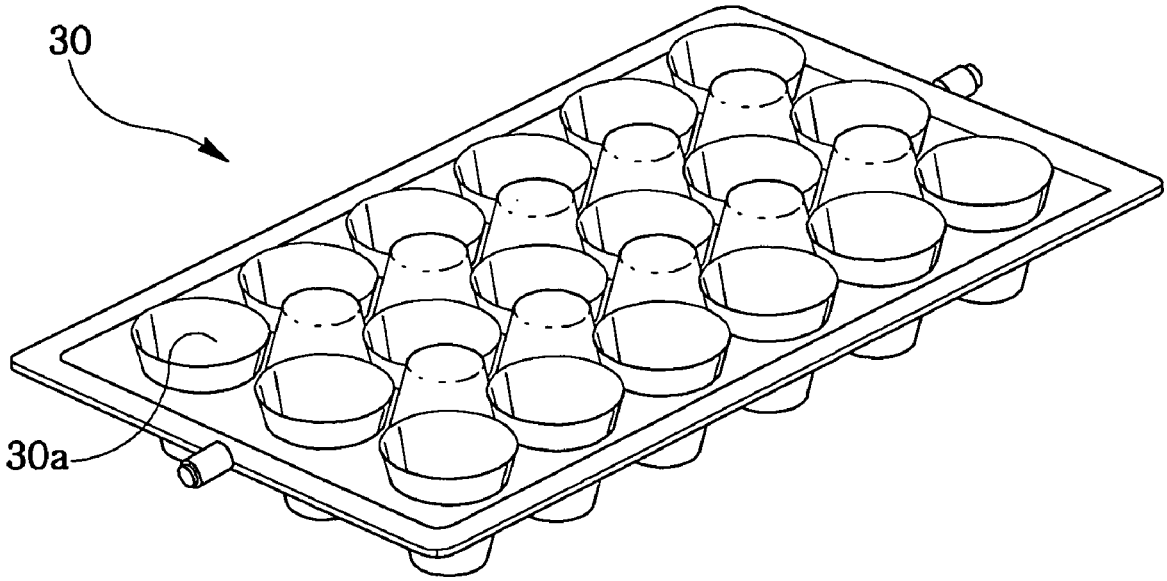
FIG. 8 is a perspective view of a first embodiment of an ice making mold according to the present invention.

The ice making mold 2 can be embodied as various embodiments. Referring to FIG. 8, the ice making mold 2 may have a double sided concavo-convex shape. The double sided concavo-convex shaped ice making mold 30 has ice making cells 30*a* in upper and lower sides thereof. After separating water into the ice making cells 30*a* and then making ice cubes, the ice cubes are released by rotating the ice making mold 30.

Figure 9:
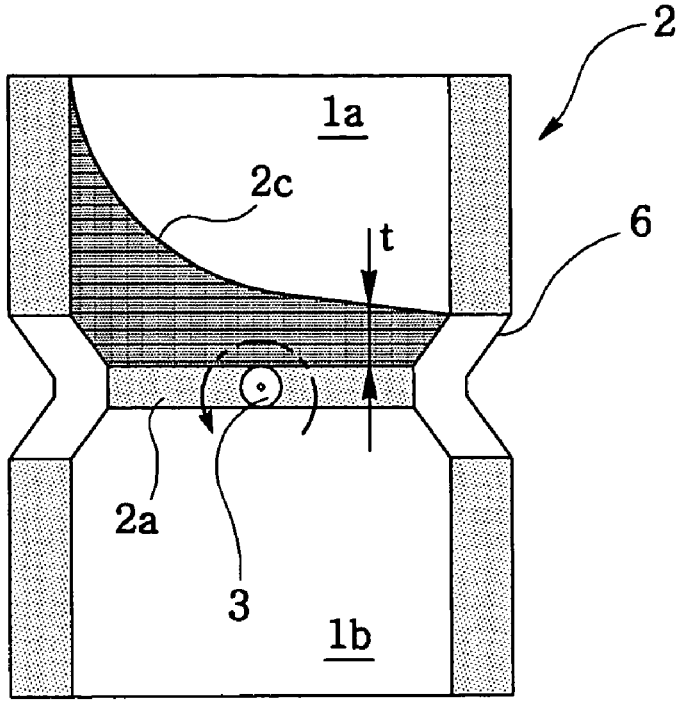
FIG. 9 is a transverse cross section view of a second embodiment of an ice making mold according to the present invention.

FIG. 9 shows a second embodiment of an ice making mold 2 according to the present invention. The ice making mold 2 comprises an upper mold having a plurality of upper ice making cavities 1*a* opened upwardly and a lower mold a plurality of lower ice making cavities 1*b* opposite to the upper ice making cavities 1*a*.

A rotating shaft 3 is inserted in the bottom wall 2*a* of the ice making mold 2 to support the ice making mold 2 and located at the center of the width thereof. To give a self-rotation to the ice making mold 2 by its own weight or by the weight of ice cubes in the upper ice making cavities 1*a*, the ice making mold 2 has the bottom wall 2*a* of thickness 't' formed in such a manner that the thickness 't' gradually increases from one side to the other side of the bottom wall 2*a*.

Figure 10:
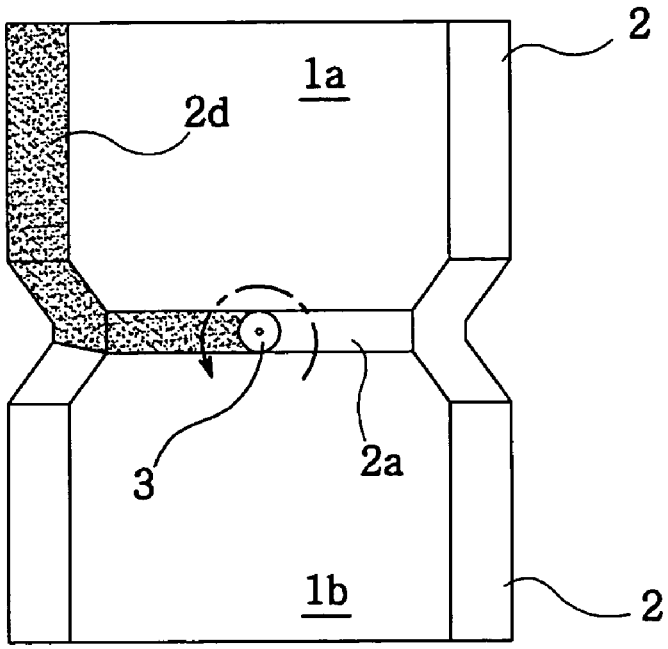
FIG. 10 is a transverse cross section view of a third embodiment of an ice making mold according to the present invention.

FIG. 10 shows a third embodiment of an ice making mold 2 according to the present invention. The ice making mold 2 comprises an upper mold having a plurality of upper ice making cavities 1*a* opened upwardly and a lower mold having a plurality of lower ice making cavities 1*b* opposite to the upper ice making cavities 1*a*.

A rotating shaft 3 is inserted in the bottom wall 2*a* of the ice making mold 2 to support the ice making mold 2 and located at the center of the width thereof. To give a self-rotation to the ice making mold 2 by its own weight or by the weight of ice cubes in the upper ice making cavities 1*a*, the one sidewall 2*d* of the ice making mold 2 is made of heavier material than that of the opposite sidewall in its own specific weight. The weight unbalance between the opposite sidewalls causes the ice making mold 2 to be self-rotated and reversed.

Figure 11:
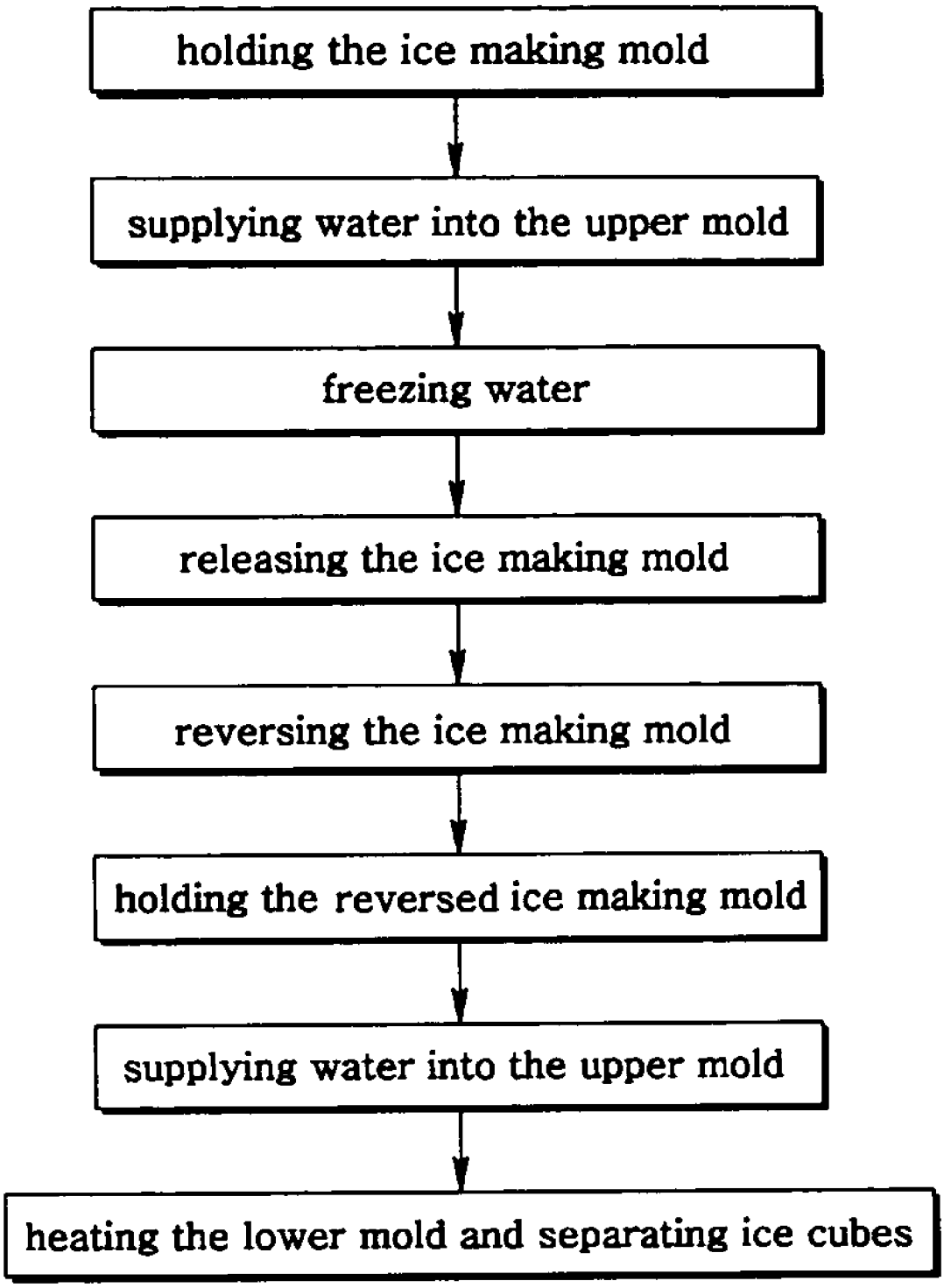
FIG. 11 is a block diagram of method of making ice cubes according to the present invention.

Method of making ice according to the present invention will be described hereinbelow with reference to FIG. 11.

Method of making ice according to the present invention comprises the steps of: holding an ice making mold having ice making cavities in upper and lower sides thereof; supplying water into the upper cavities of the ice making mold; making ice cubes by freezing water supplied into upper cavities of the ice making mold; releasing the ice making mold for rotating the ice making mold; rotating the ice making mold by its own weight or by the weight of the ice cubes in the ice making mold; holding the ice making mold in a reversed position; supplying water into upper cavities of the reversed ice making mold; and separating the ice cubes from the lower cavities by their own weight.

When the solenoid 4 is 'on' to hold the ice making mold, the fixing shaft 4*a* of the mold position fixing device moves forwardly and is inserted into the fixing groove 6 of the ice making mold 2, thereby holding the ice making mold 2 in a fixed state. In this state, water is supplied through the water supply pipe 5 to the upper cavities 1*a* of the ice making mold 2. The water in the upper cavities 1*a* is frozen until ice making is finished. Then, if the solenoid 4 is 'off', the fixing shaft 4*a* is retracted from the fixing groove 6 of the ice making mold 2. The ice making mold 2 is rotated about the rotating shaft 3 at an angle of 180 degrees by the weight of the ice cubes and reversed.

When the ice making mold 2 is reversed, the lower ice making cavities containing ice cubes face downwardly. At this time, the solenoid 4 pushses the fixing shaft 4*a* into the fixing groove 6 of the ice making mold 2, thereby holding the ice making mold in a reversed position.

Then, water is poured into the empty upper ice making cavities reversed to be faced upwardly, and then the ice cubes in the downwadly faced ice making cavities is melted by heat transferred from the water in the upper ice making cavities, and dropped by their own weight. As a result, the ice cubes are separated from the lower ice making cavities faced downwardly.

Thus, if the above procedure is repeated continuously, the ice cubes can be obtained even without additional ice ejecting devices.

Figure 12:
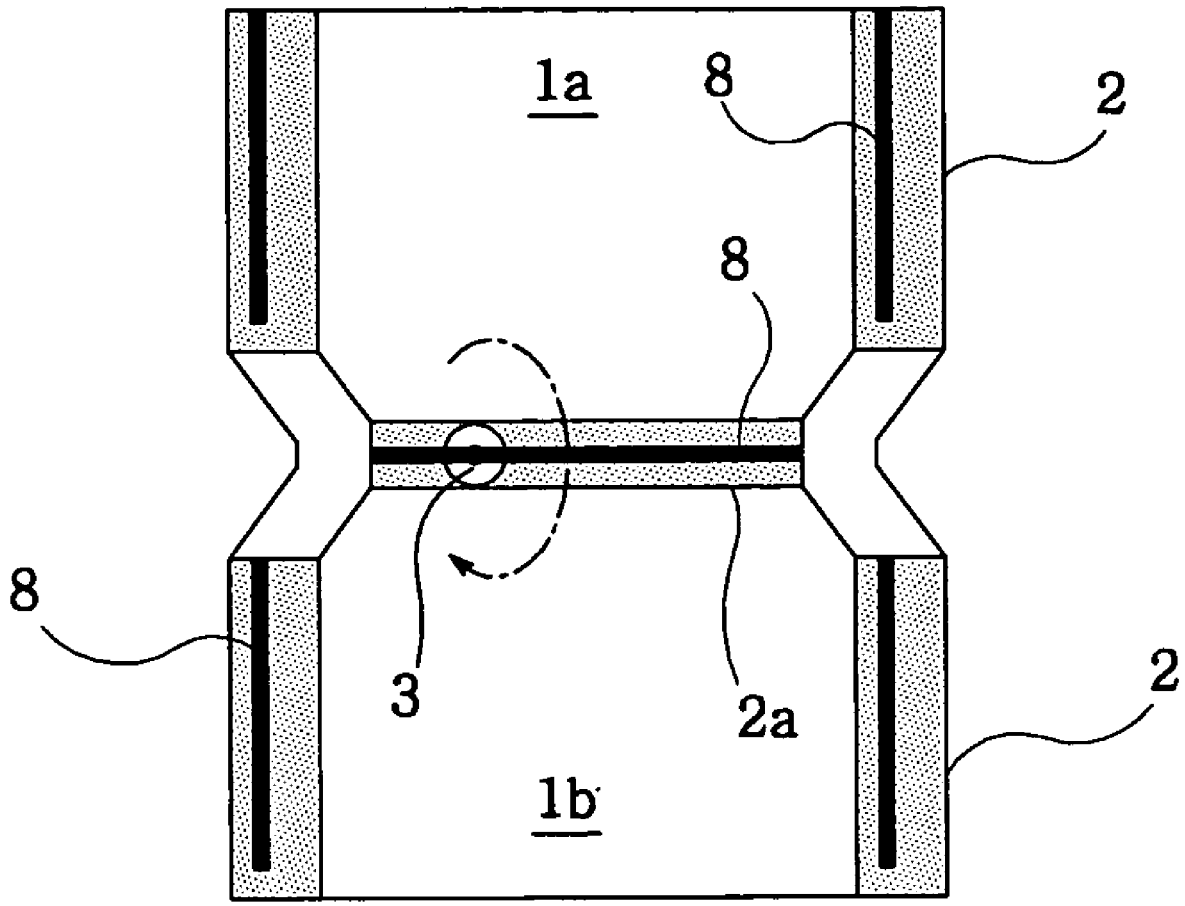
FIG. 12 is a transverse cross section view of another embodiment of a rotary type ice maker according to the present invention.

The ice making mold 2, as shown in FIG. 12, may be provided with a heater 8 in the whole surfaces of all the walls thereof for separating the ice cubes in a short time.

Since the ice cubes are released by their own weight by rotating the ice making mold 2, additional ejecting devices for extracting the ice cubes are not required. Further, even though the number of parts of the ice maker is reduced, the ice maker of the invention has the same performance for ice making and ice-release as the conventional ice maker. Thus, the cost of products can be substantially decreased. Further, the maintenance of the ice maker is facilitated due to the simple structure of the ice maker.

As mentioned above, the present invention can reduce the number of parts of the ice maker, so additional ejecting devices are not necessary. Accordingly, price competitiveness of products can be secured by a reduction of the number of parts thereof and a reduction of the material costs. Further, according to the rotary type ice maker of the invention, the heat quantity spent in separating the ice cubes can be decreased. Such a decrease can be conducive to the performance for temperature maintenance of the refrigerator and thus improve an ice making performance of the ice maker.

While the rotary type ice maker according to the preferred embodiments of the invention has been described with reference to the drawings attached hereto, it is to be understood that the invention should not be limited to the embodiments and drawings and various modifications may be made without deviating from the scope of the concept of the invention.

What is claimed is:

1. A rotary type ice maker, the ice maker comprising:

an ice making mold having ice making cavities in upper and lower sides thereof, respectively;

a rotating shaft for supporting the ice making mold so that the ice making mold is rotated by its own weight or by the weight of ice cubes in the ice making cavities; and a water supply pipe for supplying water to the ice making mold.

2. The ice maker of claim 1, further comprising a water supply cup for supplying water into the ice making mold.

3. The ice maker of claim 1, wherein the upper and lower sides of the ice making mold have a symmetrical shape each other.

4. The ice maker of claim 1, wherein the ice making mold has a double sided concavo-convex shape.

5. The ice maker of claim 1, wherein upper and lower inner walls of the ice making mold are coated with substance for increasing thermal conductivity of the inner sidewalls and minimizing a friction force between the inner sidewalls and the ice cubes.

6. The ice maker of claim 1, wherein the rotating shaft is longitudinally installed in a bottom wall of the ice making mold and located eccentrically in a width direction thereof.

7. The ice maker of claim 1, wherein the thickness of one side of the bottom wall of the ice making mold is greater than that of the other side of the bottom wall thereof, whereby the ice making mold has an asymmetrical shape from side to side.

8. The ice maker of claim 1, wherein the ice making mold is made of different kinds of materials having different specific weights, whereby one side thereof is heavier than the other side thereof.

9. The ice maker of claim 1, wherein the ice making mold is provided with a heater in the wall surface thereof for separating the ice cubes from the wall surface.

10. A rotary type ice maker, the ice maker comprising:

an ice making mold having ice making cavities in upper and lower sides thereof, respectively, the ice making cavities corresponding each other;

a rotating shaft for supporting the ice making mold so that the ice making mold is rotated by its own weight or by the weight of ice cubes in the ice making cavities;

a water supply pipe for supplying water into the ice making mold; and a mold position fixing device for fixing or releasing the ice making mold by holding the ice making mold or releasing the ice making mold.

11. The ice maker of claim 10, wherein the rotating shaft is longitudinally installed in a bottom wall of the ice making mold and located eccentrically in a width direction thereof.

12. The ice maker of claim 10, wherein the mold position fixing device comprises a fixing shaft moved forwardly or backwardly by a solenoid.

13. The ice maker of claim 12, wherein the ice making mold comprises a fixing groove formed on at least one sidewall thereof to be engaged with the fixing shaft of the solenoid moved forwardly for holding the ice making mold.

14. A method for making ice using a rotary type ice maker, the method comprising the steps of:

holding an ice making mold having ice making cavities in upper and lower sides thereof, respectively, the ice making cavities corresponding each other;

supplying water into upper cavities of the ice making mold;

making ice cubes by freezing water supplied into upper cavities of the ice making mold;

releasing the ice making mold for rotating the ice making mold;

rotating the ice making mold by its own weight or by the weight of the ice cubes in the ice making mold;

holding the ice making mold in a reversed position;

supplying water into upper cavities of the reversed ice making mold; and separating the ice cubes in lower cavities by their own weight.

15. The method of 14, wherein the step of separating the ice cubes is heating and separating the ice cubes in the lower cavities by heat transferred from water supplied into the upper cavities to the lower cavities.

16. The method of 14, wherein the step of rotating the ice making mold is rotating the ice making mold at an angle for dropping the ice cubes in the ice making mold by their own weight.

* * * * *